United States Patent [19]

Taguchi et al.

[11] Patent Number: 4,616,599

[45] Date of Patent: Oct. 14, 1986

[54] COOLING ARRANGEMENT FOR WATER-COOLED INTERNAL COMBUSTION ENGINE

[75] Inventors: Takafumi Taguchi; Masahiro Nakano; Nobuo Hiramoto, all of Hiroshima; Hideki Tominaga, Higashihiroshima, all of Japan

[73] Assignee: Mazda Motor Corporation, Hiroshima, Japan

[21] Appl. No.: 698,531

[22] Filed: Feb. 5, 1985

[30] Foreign Application Priority Data

| | | | |
|---|---|---|---|
| Feb. 9, 1984 | [JP] | Japan | 59-23699 |
| Feb. 9, 1984 | [JP] | Japan | 59-23700 |
| Feb. 9, 1984 | [JP] | Japan | 59-23701 |
| Feb. 14, 1984 | [JP] | Japan | 59-26782 |

[51] Int. Cl.[4] ..... F01P 7/16

[52] U.S. Cl. ..... 123/41.1

[58] Field of Search ..... 123/41.02, 41.08, 41.09, 123/41.1, 41.12, 41.44

[56] References Cited

U.S. PATENT DOCUMENTS

| | | | |
|---|---|---|---|
| 4,381,736 | 5/1983 | Hirayama | 123/41.1 |
| 4,475,485 | 10/1984 | Sakakibara et al. | 123/41.1 |
| 4,479,532 | 10/1984 | Watanabe | 123/41.12 |
| 4,489,680 | 12/1984 | Spokas et al. | 123/41.1 |

FOREIGN PATENT DOCUMENTS 168017 10/1982 Japan .

*Primary Examiner*—William A. Cuchlinski, Jr.
*Attorney, Agent, or Firm*—Burns, Doane, Swecker and Mathis

[57] ABSTRACT

In a cooling arrangement for an internal combustion engine, adapted to control a circulating amount of cooling water between a water jacket of the engine and a radiator, it is so arranged that control gain is variable according to the state of operations of the engine in order to achieve a compatibility between the response in control and prevention of hunting phenomenon.

21 Claims, 18 Drawing Figures

Fig. 4
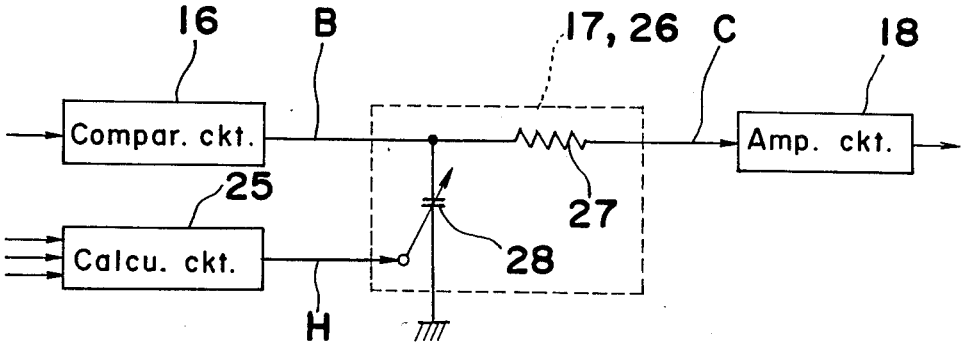
Fig. 5 (1)
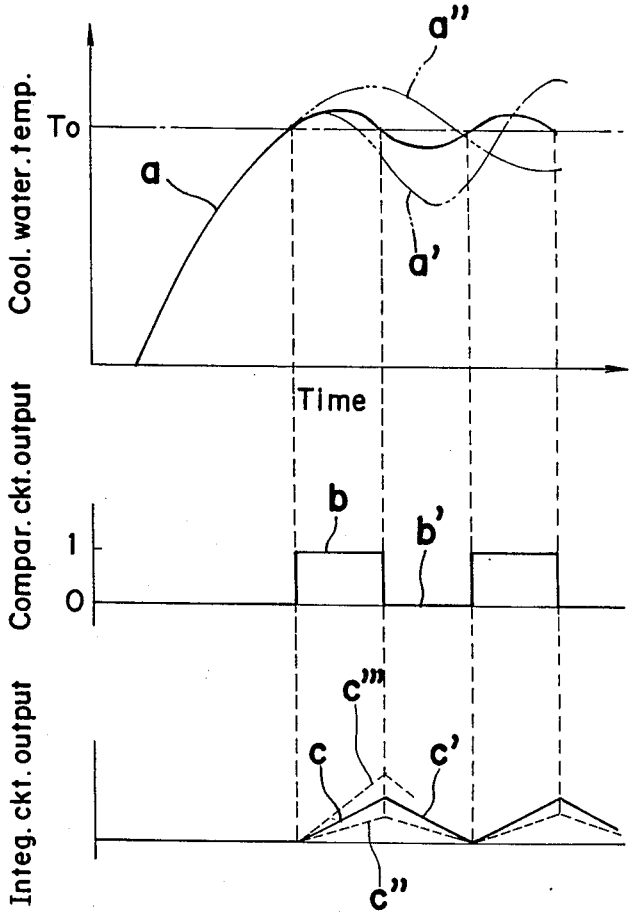
Fig. 5 (2)
Fig. 5 (3)

Fig. 9(1)
Fig. 9(2)
Fig. 9(3)
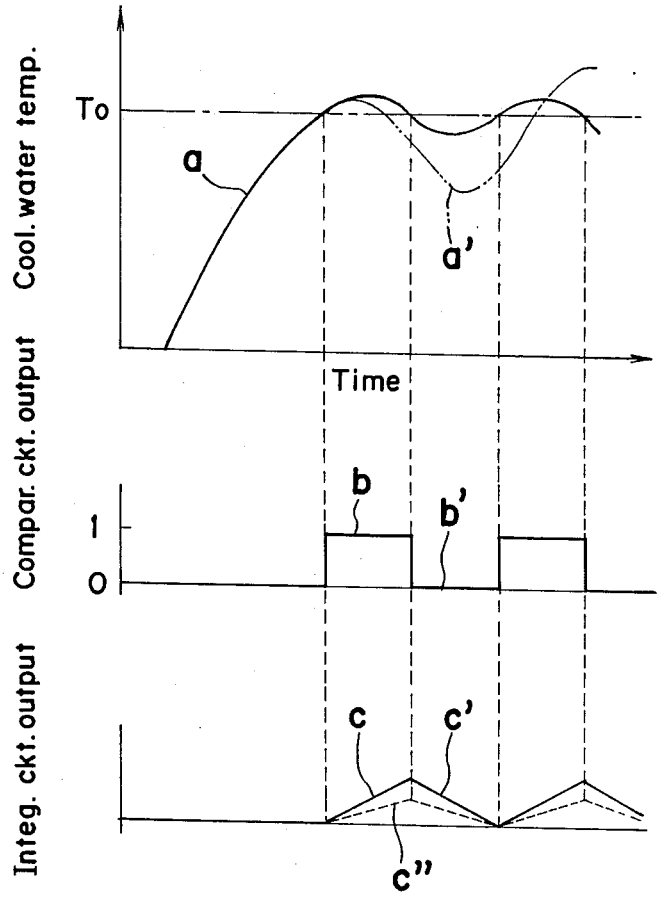
Fig. 10
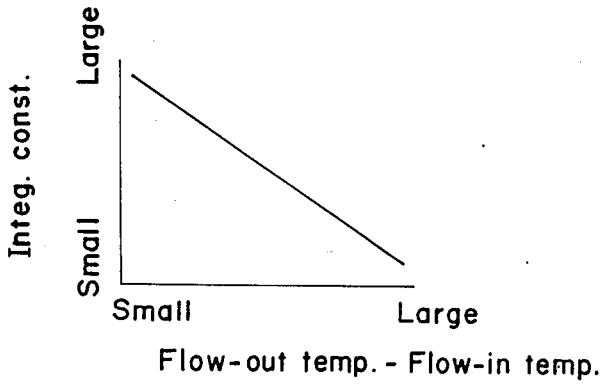

COOLING ARRANGEMENT FOR WATER-COOLED INTERNAL COMBUSTION ENGINE

BACKGROUND OF THE INVENTION

The present invention generally relates to a cooling system for a water-cooled internal combustion engine and more particularly, to a cooling arrangement which is adapted to properly control temperatures of cooling water according to the state of operations of the internal combustion engine.

Conventionally, as a cooling system of an internal combustion engine, there has been widely employed a cooling arrangement of a cooling water circulating type which is so arranged that cooling water at a low temperature is supplied into a water jacket provided around cylinders of the engine, while the cooling water heated up to a high temperature by cooling said cylinders is fed to a radiator so as to be again supplied into the water jacket after having been cooled to a low temperature by said radiator.

In the known cooling arrangement as referred to above, there is provided an on-off valve, for example of a thermostat type at an engine outlet portion in a circulating passage of the cooling water for controlling the circulating amount of the cooling water by increasing or decreasing the opening degree of said on-off valve, thereby to maintain the cooling water temperature in the engine outlet portion at a predetermined value. However, in the control of cooling water temperature as described above, there are problems related to the so-called delay in response and hunting, resulting in inconveniences as follows. Specifically, in order to reduce the delay in response, it may be so arranged as to rapidly increase the circulating amount of the cooling water by accelerating the functioning speed of said on-off valve in the case where the cooling water temperature is higher than the predetermined value. In the above practice, however, for example, when the temperature of the cooling water flowing into the engine is low as affected by atmospheric temperatures, etc. or when the flow rate of the cooling water to be varied according to engine revolutions is high the engine is rapidly cooled, thus causing the temperature of the cooling water to undershoot below the predetermined value to a large extent, with a consequent generation of the undesirable hunting in a large amplitude. Meanwhile, for reducing the hunting, the functioning speed of the on-off valve referred to earlier may be lowered, but in that case, the delay in the response in control becomes conspicuous, requiring a long period of time for a high cooling water temperature to be lowered to a predetermined value, and therefore, there is a possibility that the engine is subjected to over-heating when it is under the state of a high load, with a large heating value.

Incidentally, with respect to control for cooling water-cooled engines, there has conventionally been proposed, for example, in Japanese Laid-Open Patent Publication Tokkaisho No. 57-168017, a cooling and control apparatus for water-cooled internal combustion engines. With attention directed to the problem that, even when the cooling water temperature is controlled to be constant, since the heating value of the engine varies depending on the state of operations, the engine is brought into an over-cooled state during small load periods with less heating value, the prior art cooling and control apparatus includes a cooling restricting device such as a flow rate control valve and the like for restricting a cooling capacity of the cooling system, a sensor for producing a signal correlated to temperatures at cylinder walls, and a control circuit for driving said cooling restricting device according to the output of said sensor, whereby the cooling restricting device is controlled by said control circuit based on a table predetermined according to the state of operations or the cooling restricting device is subjected to a feed-back control so that the cylinder wall temperature reaches a predetermined value by directly detecting such cylinder wall temperature. In the above prior art, however, a delay in response is also present before the cooling water temperature and/or cylinder wall temperature reaches the predetermined value after starting of said cooling restricting device, and there is also involved the problem as referred to earlier that, for decreasing the delay in response, the hunting phenomenon tends to become conspicuous in the case where the flow-in cooling water temperature is low or where the flow rate of the cooling water is high.

SUMMARY OF THE INVENTION

Accordingly, an essential object of the present invention is to provide an improved cooling arrangement for a water-cooled internal combustion engine adapted to control cooling water temperature through adjustment of a circulating amount of the cooling water between a radiator and a water jacket, which is capable of effectively suppressing undesirable hunting of the cooling water temperatures without inviting any problem related to a delay in response when the engine has a large heating value, etc., by arranging operating speeds and/or functioning amount of an adjusting device such as on-off valve for adjusting the circulating amount of the cooling water, to be varied according to the state of operations of the engine.

Another important object of the present invention is to provide a cooling arrangement of the above described type, which is capable of effectively suppressing undesirable hunting when the temperature of the cooling water flowing in is low, without deteriorating response characteristics for the control, by arranging operating speeds and/or functioning amount, of an adjusting device such as an on-off valve for adjusting the circulating amount of the cooling water, to be varied according to the temperatures of the cooling water flowing into the engine.

A further object of the present invention is to provide a cooling arrangement of the above described type, which is capable of effectively suppressing undesirable hunting when flow-rate of the cooling water is high, without deteriorating response characteristics for the control, by arranging operating speeds and/or functioning amount of an adjusting device such as an on-off valve for adjusting the circulating amount of the cooling water, to be varied according to the flow-rate of the cooling water.

In accomplishing these and other objects, according to the present invention, there are provided improved cooling arrangements for a water-cooled internal combustion engine having a radiator, a water jacket provided around cylinders of the engine, and a cooling water passage for circulating the cooling water between said radiator and water jacket, characterized in constructions as follows.

In the first aspect of the present invention, the cooling arrangement for the water-cooled internal combustion engine of the above described type includes a cooling water temperature detecting means for outputting signal related to the cooling water temperatures, an adjusting device such as an on-off valve or the like for adjusting a circulating amount of the cooling water between the radiator and the water jacket, and a cooling water temperature control means for controlling the circulating amount of the cooling water by operating the adjusting device according to the output of said cooling water temperature detecting means, thereby to control the cooling water temperatures to be below a predetermined value.

In addition to the above, there are further provided an operating condition detecting means for detecting the state of operation of the engine, and a control gain control means for varying the control or modifying gain with respect to the adjusting device by the above cooling water temperature control means according to the output of the operating condition detecting means.

The operating condition detecting means detects, for example, temperatures of the cooling water flowing into the engine or atmospheric temperatures related thereto and time elapsed from starting of the engine, etc., flow-rate of the cooling water or revolutions of a cooling pump and/or the engine related thereto, etc., and engine heating value or engine load related thereto, etc. Upon receipt of the output from the above operating condition detecting means, the control gain control or modifying means functions to decrease the control gain when the flow-in cooling water temperature is low or flow-rate is high, and also to increase the control gain when the heating value is large, whereby the operating speed or functioning amount of the adjusting device is controlled to be varied according to the state of operations of the engine, and thus, the undesirable hunting phenomenon due to low flow-in cooling water temperatures or high flow-rate of the cooling water may be suppressed without producing over-heating and the like due to the delay in response during a large load period.

It should be noted here that, for the above adjusting device, besides the on-off valve electrically controlled for the opening degree, a conventional on-off valve of a thermostat type may also be employed. In this case, control gain in the circulating amount control of the cooling water is varied, for example, by increasing or decreasing the passage area according to the state of operations.

In the second aspect of the present invention, the cooling arrangement of the above described type similarly includes the cooling water temperature detecting means for outputting signals related to the cooling water temperatures, the adjusting device such as an on-off valve or the like for adjusting the circulating amount of the cooling water between the radiator and the water jacket, and the cooling water temperature control means for controlling the circulating amount of the cooling water by operating the adjusting device according to the output of said cooling water temperature detecting means, thereby to control the cooling water temperatures to be below a predetermined value. The arrangement further includes a flow-in cooling water temperature detecting means for directly or indirectly detecting the temperatures of the cooling water flowing into the engine, and a control gain control means for reducing the control gain with respect to the adjusting device by the above cooling water temperature control means when the flow-in cooling water temperature is low upon receipt of the output from said detecting means. For the flow-in cooling water temperature detecting means, there may be employed, for example, a sensor for directly detecting the flow-in cooling water temperature, a sensor for detecting atmospheric temperatures affecting the flow-in cooling water temperature or a starting timer for predicting the flow-in cooling water based on the time elapsed since starting of the engine.

By the above arrangement, through reduction of the operating speed or functioning amount of the adjusting device for adjusting the circulating amount of the cooling water when the flow-in cooling water temperature is low, hunting of the cooling water temperatures may be suppressed without inviting any delay in response during the normal period of operation.

It should be noted here that, for the above adjusting device also, besides the on-off valve electrically controlled for the opening degree, the conventional on-off valve of a thermostat type may be employed. In this case, control gain in the circulating amount control of the cooling water is varied, for example, by increasing or decreasing the passage area according to the temperatures of the flow-in cooling water.

In the third aspect of the present invention, the cooling arrangement of the present invention also includes the cooling water temperature detecting means for outputting signal related to the cooling water temperatures, the adjusting device such as an on-off valve or the like for adjusting a circulating amount of the cooling water between the radiator and the water jacket, and the cooling water temperature control means for controlling the circulating amount of the cooling water by operating the adjusting device according to the output of said cooling water temperature detecting means, thereby to control the cooling water temperatures to be below a predetermined value. In addition to the above, there are further provided a cooling water flow-rate detecting means for directly or indirectly detecting the flow-rate of the cooling water, and a control gain control means for reducing the control gain with respect to the adjusting device by the above cooling water temperature control means when the flow-rate is high upon receipt of the output from said detecting means. For the above cooling water temperature flow-rate detecting means, there may be employed, for example, a sensor for detecting revolutions of a cooling water pump or an engine for driving the pump, besides a sensor for directly detecting the flow-rate.

By the above arrangement, through reduction of the operating speed or functioning amount of the adjusting device for adjusting the circulating amount of the cooling water when the cooling water flow-rate to be detected by such a sensor is high, hunting of the cooling water temperatures may be suppressed without inviting any delay in response during the normal period of operation.

It should also be noted here that, for the above adjusting device, besides the on-off valve electrically controlled for the opening degree, the conventional on-off valve of a thermostat type may also be adopted. In this case, control gain in the circulating amount control of the cooling water is varied, for example, by increasing or decreasing the passage area according to the flow-rates of the cooling water.

BRIEF DESCRIPTION OF THE DRAWINGS

These and other objects and features of the present invention will become apparent from the following description taken in conjunction with the preferred embodiments thereof with reference to the accompanying drawings, in which:

FIG. 4 is an electrical circuit diagram showing a specific example of an integration circuit and an integral constant setting circuit in the arrangement of FIG. 1;

FIGS. 5(1) through 5(3) are time-charts for explaining functions of the arrangement of FIG. 1;

FIGS. 9(1) through 9(3) are time-charts for explaining functions of the arrangement of FIG. 6;

FIG. 10 is a graph similar to FIG. 7, which is particularly related to a modified arrangement;

DETAILED DESCRIPTION OF THE INVENTION

Figure 1:
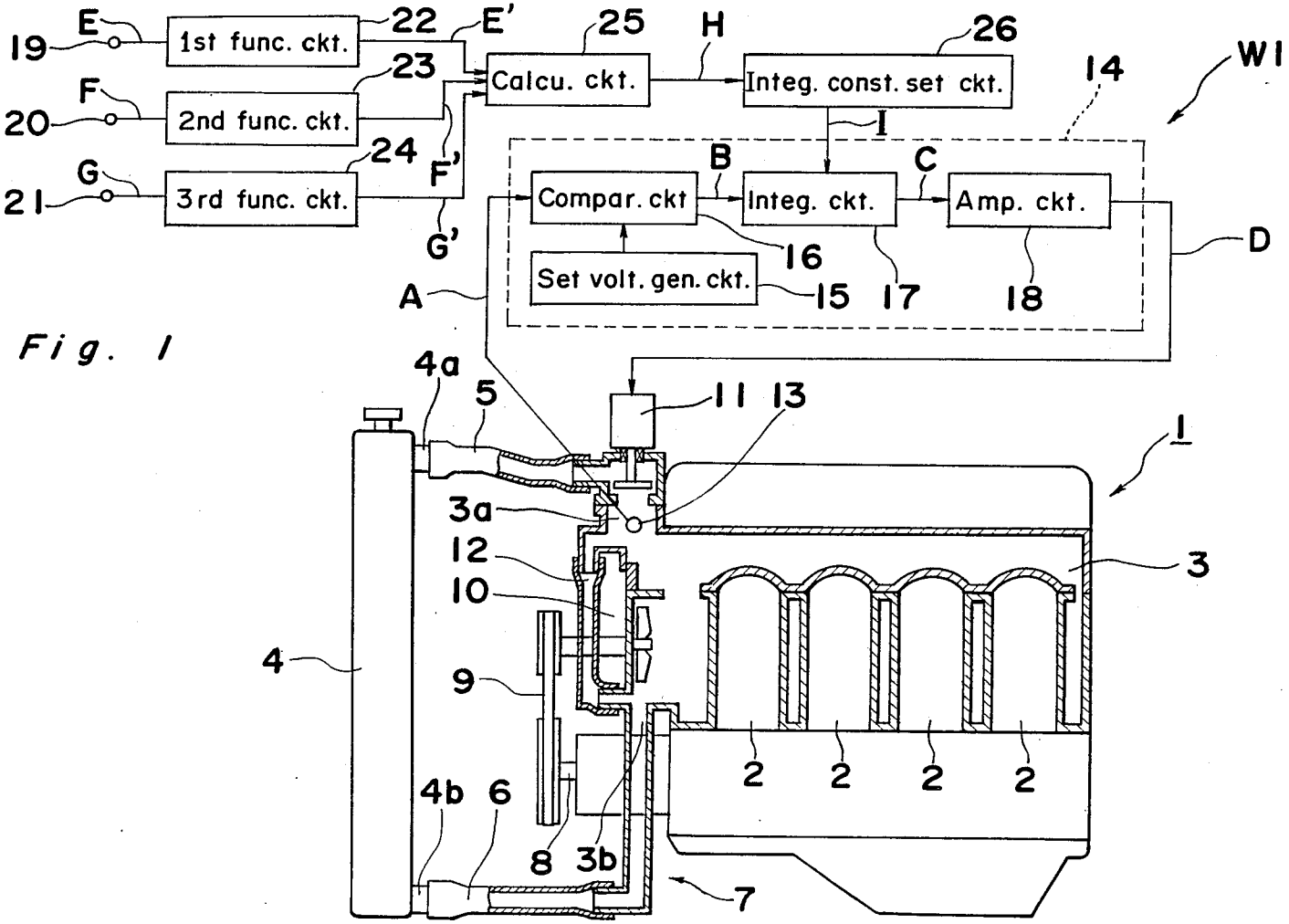
FIG. 1 is a schematic side sectional view of a water-cooled internal combustion engine together with a block diagram for a cooling arrangement according to one preferred embodiment of the present invention.

Before the description of the present invention proceeds, it is to be noted that like parts are designated by like reference numerals throughout the accompanying drawings.

Referring now to the drawings, there is shown in FIG. 1 a water-cooled internal combustion engine 1 to which a cooling arrangement W1 according to the present invention is applied. The internal combustion engine 1 includes a plurality of cylinders 2, and a water jacket 3 provided around the cylinders 2 in a known manner, with an outlet 3*a* of the water jacket 3 being connected through a pipe 5 to an inlet 4*a* of a radiator 4 provided in the vicinity of the engine 1, while an inlet 3*b* of said water jacket 3 is coupled to an outlet 4*b* of the radiator 4 through a pipe 6 so as to form a circulating passage 7 for cooling water between the water jacket 3 and the radiator 4. In the vicinity of the inlet 3*b* for the water jacket 3, there is provided a cooling water pump 10 which is driven by a crank shaft 8 of the engine 1 through a belt 9, while, adjacent to the outlet 3*a* of the water jacket 3, an on-off valve 11 is provided so as to function as an adjusting device for increasing or decreasing a flow-out amount (i.e., circulating amount) of the cooling water from said outlet 3*a* toward the side of the pipe 5 and the radiator 4. In the above construction, between the outlet 3*a* of the water jacket 3 and the inlet 3*b* thereof, there is provided a by-pass passage 12 for circulating the cooling water without feeding thereof to the radiator 4 during closure of the on-off valve 11.

Moreover, in a position immediately upstream of said on-off valve 11 in the water jacket 3, a water temperature sensor 13 is provided for detecting the cooling water temperature at an engine outlet portion, so that a water temperature signal A output from said sensor 13 is input to a control circuit 14 surrounded by dotted lines. This control circuit 14 applied with the water temperature signal A includes comparison circuit 16 which compares a voltage level of the signal A with a voltage level corresponding to a target cooling water temperature produced from a set voltage generation circuit 15 and produces a signal B of "1" when the voltage level of the former is higher than that of the latter, an integration circuit 17 for integrating the output signal B of said comparison circuit 16, and an amplification circuit 18 for amplifying an output signal C of said integration circuit 17, with an output signal from said amplification circuit 18 being fed to said on-off valve 11 as a control signal D. Thus, the on-off valve 11 is arranged to be actuated according to values of the control signal D so as to increase or decrease the degree of opening of the passage leading from the water jacket 3 to the pipe 5 and the radiator 4.

Figure 2:
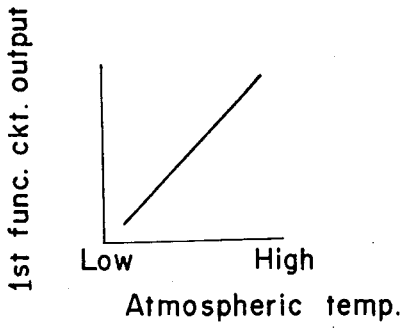
FIGS. 2(1) through 2(3) are respectively output characteristic diagrams for first to third function circuits employed in the arrangement of FIG. 1.
Figure 2:
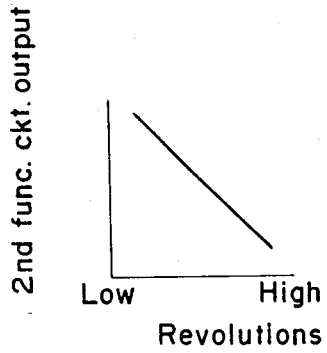
Figure 2:
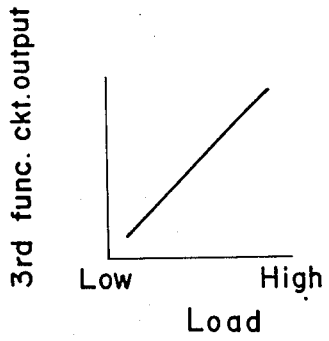
Figure 3:
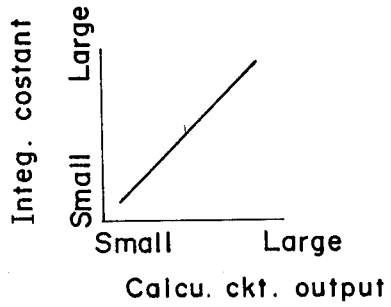
FIG. 3 is an output characteristic diagram for an integral constant setting circuit employed in the arrangement of FIG. 1.

According to the above embodiment of the cooling arrangement W1 in FIG. 1, in addition to the construction as described so far, there are further provided an atmospheric temperature sensor 19 for indirectly detecting temperatures of the cooling water flowing into the water jacket 3 from the inlet 3*b*, a revolution sensor 20 for detecting revolutions of the engine 1, and also, a load sensor 21 for detecting magnitudes of loads for the engine 1 from opening degrees of a throttle valve, intake negative pressure, etc. Output signals E, F and G from these sensors 19, 20 and 21 are respectively applied to first, second and third function circuits 22, 23 and 24, and converted into function values at characteristics as shown in FIGS. 2(1) through 2(3). In other words, the first function circuit 22 produces the function value increasing as the atmospheric temperature represented by the output signal E of the sensor 19 becomes higher, and the second function circuit 23 outputs the function value decreasing as the engine revolutions represented by the output signal F of the sensor 20 increase, while the third function circuit 24 generates the function value increasing as the engine load represented by the output signal G of the sensor 21 increases. Thus, signals E′, F′ and G′ representing these function values are applied to a calculation circuit 25, and after being subjected to predetermined calculation processings thereat, fed from said calculation circuit 25 to an integral constant setting circuit 26 as a signal H. As shown in FIG. 3, the above integral constant setting circuit 26 determines an integral constant which increases as the output signal H of the calculation circuit 25 increases, i.e., integral constant which decreases as the atmospheric temperature is lowered, also decreases as the engine revolutions become larger, and increases with an increase of the engine load so as to be applied, as a signal I, to the integration circuit 17 of the control circuit 14, and thus, the above integral constant is adapted to be utilized as an integral constant for subjecting the output signal B of the comparison circuit 16 to the integral processing in the integration circuit 17.

As shown in FIG. 4, for example, the above integration circuit 17 and the integral constant setting circuit 26 surrounded by dotted lines are constituted by a resistor 27 connected between the comparison circuit 16 and the amplification circuit 18, and a variable capacitor 28 inserted between the comparison circuit 16 and the calculation circuit 25 so as to be grounded. Since the variable capacitor 28 is adapted to be altered in its capacity according to the output signal H from the calculation circuit 25, the integral constant is caused to vary as described earlier.

Subsequently, functions of the cooling arrangement W1 of the present invention as described so far will be explained hereinbelow.

Upon starting the internal combustion engine 1, the cooling water pump 10 is driven by the crank shaft 8 through the belt 9, and thus, the cooling water within the water jacket 3 is caused to flow from the side of the inlet 3*b* toward the side of the outlet 3*a* through the peripheral portions of the respective cylinders 2. However, since the cooling water temperature is low immediately after the starting, the output of the comparison circuit 16 is "0" in the control circuit 14 to which the water temperature signal A is applied from the water temperature sensor 13 provided in the vicinity of the outlet 3*a* of the water jacket 3, and accordingly, the control signal D to be fed from said control circuit 14 to the on-off valve 11 is also "0", with said on-off valve 11 being in the state to close said outlet 3*a*. Therefore, the cooling water is not supplied to the radiator 4 at the above time point, but is circulated through the by-pass passage 12.

Then, as time passes from the starting of the engine 1, the cooling water temperature rises as shown in a solid line curve a in FIG. 5(1), and at a time point where said cooling water temperature has reached a set value To (e.g., 85° C.), the voltage level of the water temperature signal A from the water temperature sensor 13 exceeds the output voltage level of the set voltage generation circuit 15 in the control circuit 14. Therefore, the output signal B of the comparison circuit 16 is changed to "1" as shown at a symbol b in FIG. 5(2), and following the above, the output signal C of the integration circuit 17 rises at a certain constant gradient as indicated by a symbol c in FIG. 5(3). Thereafter, the output signal C of the integration circuit 17 is fed to the on-off valve 11 as the control signal D through the amplification circuit 18, and the degree of opening of said on-off valve 11 increases with rising of the output value of the control signal D (the output signal C of the integration circuit 17), whereby the cooling water within the water jacket 3 is fed to the radiator 4 so as to correspond to the opening degree of the on-off valve, and the circulating amount of the cooling water passing through the radiator 4 is gradually increased.

When the circulating amount of the cooling water passing through the radiator 4 increases as described above, the cooling water temperature stops rising, and then, is started to be lowered. At the time point when the cooling water temperature has been lowered to the set value To as referred to earlier, the output signal B of the comparison circuit 16 in the control circuit 14 is changed to "0" as shown by a symbol b' in FIG. 5(2), while the value of the output signal C of the integration circuit 17 and that of the control signal D start to decrease as indicated by a symbol c' in FIG. 5(3), and following the above, the opening degree of the on-off valve 11, i.e., the circulating amount of the cooling water passing through the radiator 4 is reduced. Therefore, the cooling water temperature again rises after having been lowered to the predetermined temperature, and consequently, the cooling water temperature at the outlet 3*a* of the water jacket 3 fluctuates upwardly or downwardly with respect to the set value To as shown by the solid line curve a in FIG. 5(1), thus resulting in the hunting.

Incidentally, in the control of the cooling water temperature as described above, when the temperature of the cooling water flowing into the water jacket 3 from the radiator 4 is low owing to low atmospheric temperatures, the engine 1 is more quickly cooled with respect to the constant valve opening speed of the on-off valve 11, thus resulting in a rapid lowering of the cooling water temperature at the outlet 3*a* of the water jacket 3. Therefore, the cooling water temperature largely undershoots below the set value To as shown by a chain line curve a' in FIG. 5(1), with the hunting phenomenon becoming conspicuous. However, upon lowering of the atmospheric temperature, the output E' of the first function circuit 22 to which the output signal E of the sensor 19 indicating such lowering is input, is reduced as shown in FIG. 2(1), and following this, the integral constant set at the integral constant setting circuit 26 is decreased. Accordingly, the signal C produced from the integration circuit 17 of the control circuit 14 has a gentle gradient as indicated by a dotted line C" in FIG. 5(3). This means that the control gain of the control with respect to the on-off valve 11 by the control circuit 14 is decreased, and thus, the valve opening speed of the on-off valve 11 when the cooling water temperature has exceeded the set value To is to be lowered. As a result, lowering of the cooling water temperature at the outlet 3*a* of the water jacket 3 becomes gentle in spite of the low flow-in cooling water temperature, and the undesirable undershooting or hunting may be alleviated as shown by the solid line curve a in FIG. 5(1).

In the embodiment as described so far, there are further provided the revolution sensor 20 and the load sensor 21 besides the atmospheric temperature sensor 19 referred to above, so that the control gain may be altered also by the engine revolutions and engine load as detected by these sensors 20 and 21.

More specifically, when the engine revolutions are high, the number of revolutions of the cooling water pump 10 is also increased, with a consequent higher flow-rate of the cooling water to be supplied to the water jacket 3, and thus, the cooling water temperature is rapidly lowered with respect to the constant valve opening speed for the on-off valve 11, and the hunting becomes conspicuous as represented by the chain line a' in FIG. 5(1). In this case, however, due to the fact that the integral constant set at the integral constant setting circuit 26 becomes small as shown in FIG. 2(2) and FIG. 3, the valve opening speed of the on-of valve 11 becomes gentle in the similar manner as in the case where the flow-in cooling water temperature is low, and thus, the hunting is suppressed.

On the other hand, in the case where the load for the engine 1 is large, with a consequently large heating value thereof, if the valve opening speed of the on-off valve 11 is gentle when the cooling water temperature has exceeded the set value To, said cooling water temperature largely overshoots the set value To as indicated by a chain line a" in FIG. 5(1), while the delay in the response becomes conspicuous, requiring a long period of time until the cooling water temperature lowers to the set value To, with a possibility that the engine 1 may be over-heated during that period. In the above case, however, since the integral constant set by the integral constant setting circuit 26 increases as shown in FIGS. 2(3) and FIG. 3, the output signal C of the integration circuit 17 in the control circuit 14 shows a sharp rise as shown by a symbol c''' in FIG. 5(3), accompanied by a quick increase of the opening degree of the on-off valve 11, and thus, the circulating amount of the cooling water passing through the radiator 4 is rapidly increased, with the over-heating being advantageously prevented in spite of the increase of the engine heating value.

It should be noted here that the atmospheric temperature sensor 19 provided in the foregoing embodiment for detecting the temperature of the cooling water flowing into the engine 1 may be replaced by another sensor provided at the inlet 3*b* of the water jacket 3, etc. for directly detecting the flow-in cooling water temperature, or it may be so arranged that, by utilizing the fact that the flow-in cooling water temperature rises up to the predetermined temperature generally in correspondence to the time passing from the starting of the engine 1, the flow-in cooling water temperature is adapted to be indirectly detected by a starting time timer which measures such elapsed time.

In a further modification of the embodiment in FIG. 1, the revolution sensor 20 is coupled to the first function circuit 22, while the atmospheric temperature sensor 19 is coupled to the second function circuit 23, with the load sensor 21 remaining to be connected to the third function circuit 24, although not particularly shown. Output signals F, E and G of these sensors 20, 19 and 21 are respectively applied to the first, second and third function circuits 22, 23 and 24, and converted into the function values. In other words, the first function circuit 22 outputs the function value decreasing as the engine revolutions represented by the output signal F of the sensor 20 are increased, and the second function circuit 23 produces the function value increasing as the atmospheric temperature represented by the output signal E of the sensor 19 becomes higher, while the third function circuit 24 generates the function value increasing as the engine load represented by the output signal G of the sensor 21 increases. Thus, signals F', E' and G' representing these function values are applied to the calculation circuit 25, and after being subjected to the predetermined calculation processing thereat, fed from said calculation circuit 25 to the integral constant setting circuit 26 as the signal H. As shown in FIG. 3, the above integral constant setting circuit 26 determines an integral constant which increases as the output signal H of the calculation circuit 25 increases, i.e., integral constant which decreases as the atmospheric temperature is lowered, also decreases as the engine revolutions become larger, and increases with the increase of the engine load so as to be applied, as the signal I, to the integration circuit 17 of the control circuit 14 in the similar manner as in the first embodiment of FIG. 1. This integral constant may be adapted to be utilized as the integral constant for subjecting the output signal B of the comparison circuit 16 to the integral processing in the integration circuit 17.

In still another modification of the embodiment of FIG. 1, the load sensor 21 is connected to the first function circuit 22, and the revolution sensor 20 is coupled to the second function circuit 23, while the atmospheric temperature sensor 19 is connected to the third function circuit 24, although not particularly shown. Output signals G, F and E of these sensors 21, 20 and 19 are respectively applied to the first, second and third function circuits 22, 23 and 24, and converted into the function values. In other words, the first function circuit 22 produces the function value increasing as the engine load represented by the output signal G of the sensor 21 becomes higher, and the second function circuit 23 outputs the function value decreasing as the engine revolutions represented by the output signal F of the sensor 20 increase, while the third function circuit 24 generates the function value increasing as the atmospheric temperature represented by the output signal E of the sensor 19 increases. Thus, signals G', F' and E' representing these function values are applied to the calculation circuit 25, and after being subjected to the predetermined calculation processings thereat, similarly fed from said calculation circuit 25 to the integral constant setting circuit 26 as the signal H. The above integral constant setting circuit 26 determines the integral constant which increases as the output signal H of the calculation circuit 25 increases, i.e., integral constant which decreases as the atmospheric temperature is lowered, also decreases as the engine revolutions become larger, and increases with an increase of the engine load so as to be applied, as the signal I, to the integration circuit 17 of the control circuit 14, and thus, the above integral constant may be adapted to be utilized as an integral constant for subjecting the output signal B of the comparison circuit 16 to the integral processing in the integration circuit 17 in the similar manner.

As is seen from the foregoing description, according to the present invention, in the cooling arrangement of a water-cooled internal combustion engine adapted to control the cooling water temperature by adjusting the circulating amount of the cooling water between the radiator and the water jacket, it is so arranged that the control gain with respect to the adjusting device for effecting the adjustment of the above cooling water circulating amount is varied according to the operating condition of the engine, or the temperature of the flow-in cooling water flowing into the engine or the flow-rate of said cooling water, and therefore, over-heating, etc. due to the delay in the response for the control of the cooling water temperature can be prevented during the high load period when the engine heating value is large, while in the case where the flow-in cooling water temperature is low due to the relation with respect to the atmospheric temperatures, etc. or where the flow-rate of the cooling water corresponding to the engine revolutions is high, the undesirable hunting of the cooling water temperatures may be advantageously suppressed, and thus, the cooling water temperatures may be properly controlled according to the operating condition of the engine at all times.

Figure 6:
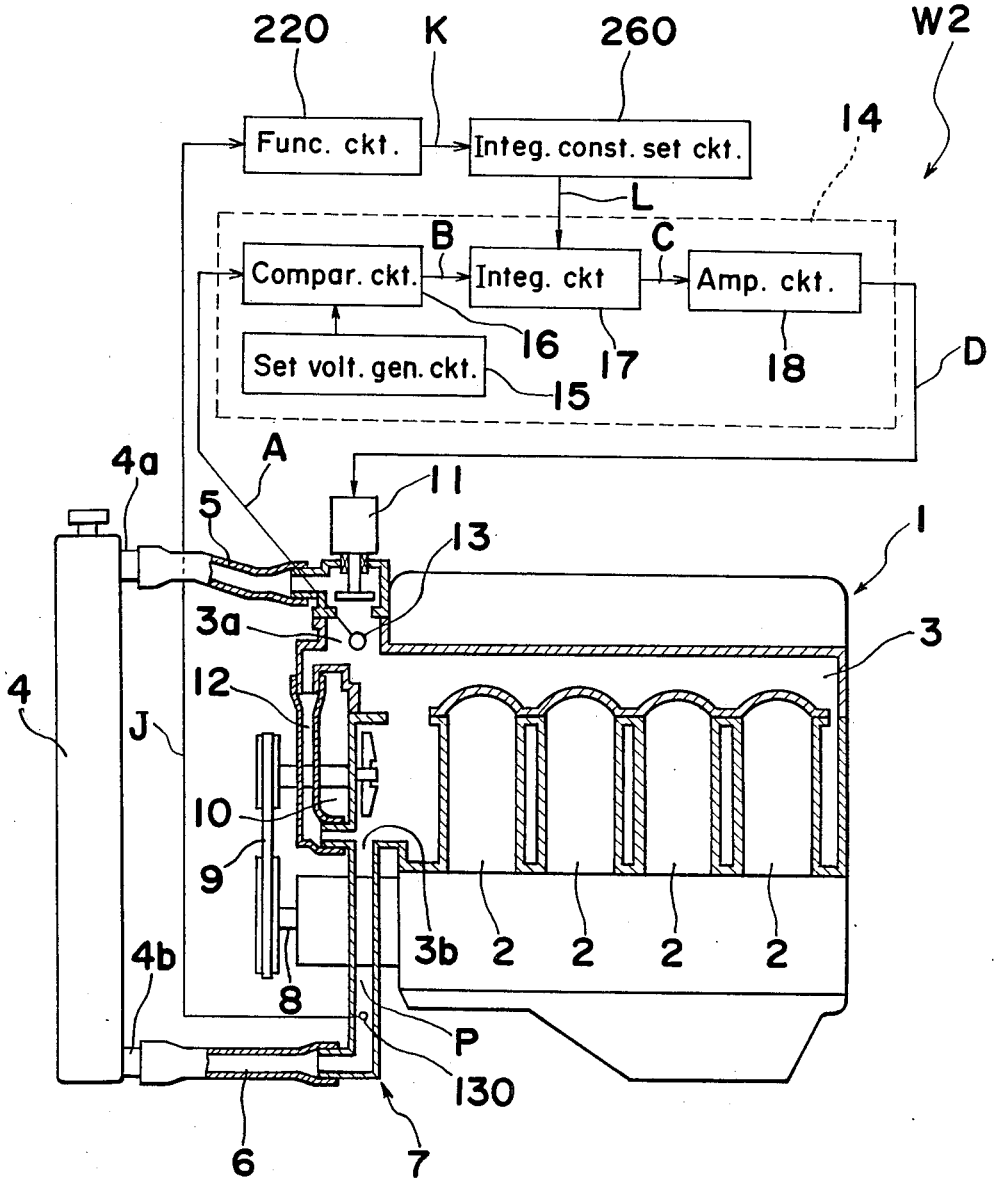
FIG. 6 is a view similar to FIG. 1, which particularly shows a second embodiment thereof.

Referring now to FIGS. 6 through 9, there is shown in FIG. 6 a cooling arrangement W2 according to a second embodiment of the present invention.

In this embodiment also, since the construction of the engine 1 and the control circuit 14 is generally the same as that in the arrangement of FIG. 1, detailed description thereof is abbreviated here for brevity, with like parts being designated by like reference numerals.

As described earlier with reference to the cooling arrangement W1 of FIG. 1, in the position immediately upstream of the on-off valve 11 in the water jacket 3, the water temperature sensor 13 is provided for detecting the cooling water temperature at the engine outlet portion, so that the water temperature signal A output from the sensor 13 is input to the control circuit 14 surrounded by the dotted lines. The control circuit 14 applied with the water temperature signal A includes the comparison circuit 16 which compares the voltage level of the signal A with the voltage level corresponding to the target cooling water temperature produced from the set voltage genertion circuit 15 and produces the signal B of "1" when the voltage level of the former is higher than that of the latter, the integration circuit 17 for integrating the output signal B of said comparison circuit 16, and the amplification circuit 18 for amplifying the output signal C of said integration circuit 17, with the output signal from said amplification circuit 18 being fed to the on-off valve 11 as the control signal D. Thus, the on-off valve 11 is arranged to be actuated according to values of the control signal D so as to increase or decrease the degree of opening of the passage leading from the water jacket 3 to the pipe 5 and the radiator 4.

Figure 7:
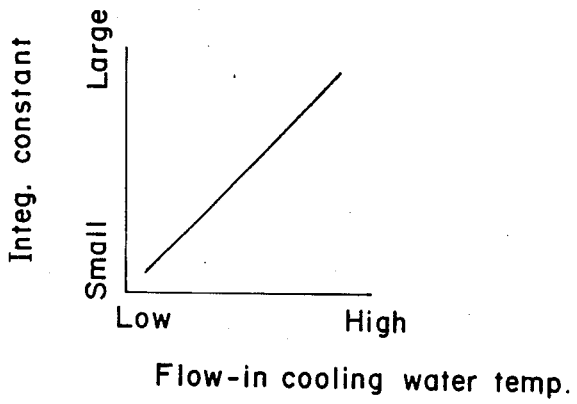
FIG. 7 is a graph showing control characteristics of the arrangement of FIG. 6.

According to the above embodiment of the cooling arrangement W2 in FIG. 6, in addition to the constructions as referred to above, there are further provided a flow-in cooling water temperature sensor 130 disposed in a passage P leading to the inlet **3*b* of the water jacket 3 for detecting temperatures of the flow-in cooling water flowing from the radiator 4 into said water jacket 3, a function circuit 220 applied with an output signal J of said sensor 130 and converting the flow-in cooling water temperature into a function value according to the predetermined function relation, and an integral constant setting circuit 260 setting the integral constant according to an output signal K of said function circuit 220 and coupled to the integration circuit 17 of the control circuit 14, thereby to determine the integral constant which decreases as the flow-in cooling water temperature is lowered as shown in FIG. 7. This integral constant is applied to said integration circuit 17 as a signal L so as to be utilized as the integral constant in the case where the output signal B of the comparison circuit 16 is subjected to the integrating processing in the integration circuit 17**.

Figure 8:
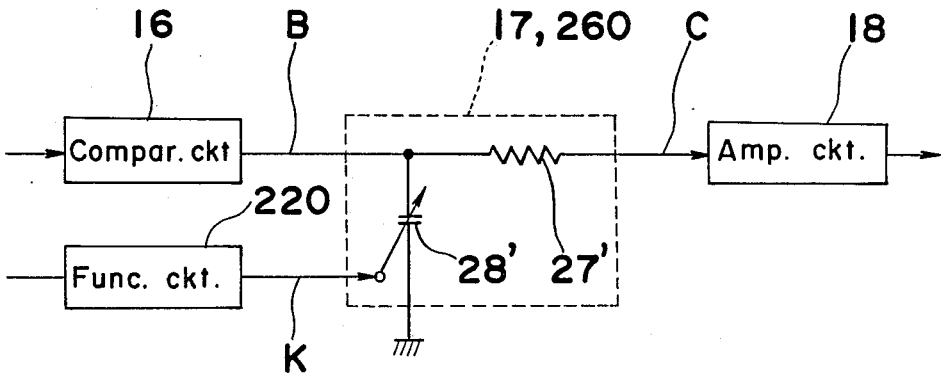
FIG. 8 is an electrical circuit diagram showing a specific example of an integration circuit and an integral constant setting circuit in the arrangement of FIG. 6.

As shown in FIG. 8, for example, the above integration circuit 17 and the integral constant setting circuit 260 surrounded by dotted lines are constituted by a resistor 27' connected between the comparison circuit 16 and the amplification circuit 18, and a variable capacitor 28' inserted between the comparison circuit 16 and the function circuit 220 so as to be grounded. Since the variable capacitor 28' is adapted to be altered in its capacity according to output signals K from the function circuit 220, the integral constant is caused to vary as described earlier.

Hereinbelow, functions of the cooling arrangement W2 of the present invention as described so far will be explained.

Upon starting the internal combustion engine 1, the cooling water pump 10 is driven by the crank shaft 8 through the belt 9, and thus, the cooling water within the water jacket 3 is caused to flow from the side of the inlet **3*b* toward the side of the outlet 3*a* through the peripheral portions of the respective cylinders 2. However, since the cooling water temperature is low immediately after the starting, the output of the comparison circuit 16 is "0" in the control circuit 14 to which the water temperature signal A is applied from the water temperature sensor 13 provided in the vicinity of the outlet 3*a* of the water jacket 3, and accordingly, the control signal D to be fed from said control circuit 14 to the on-of valve 11 is also "0", with said on-off valve 11 being in the state to close said outlet 3*a*. Therefore, the cooling water is not supplied to the radiator 4 at the above time point, but is circulated through the by-pass passage 12**.

Then, as time passes from the starting of the engine 1 in the abcve state, the cooling water temperature rises as shown in a solid line curve a in FIG. 9(1), and at a time point where said cooling water temperature has reached the set value To (e.g., 85° C.), the voltage level of the water temperature signal A from the water temperature sensor 13 exceeds the output voltage level of the set voltage generation circuit 15 in the control circuit 14. Therefore, the output signal B of the comparison circuit 16 is changed to "1" as shown at a symbol b in FIG. 9(2), and following the above, the output signal C of the integration circuit 17 rises at a certain constant gradient as indicated by a symbol c in FIG. 9(3). Thereafter, the output signal C of the integration circuit 17 is fed to the on-off valve 11 as the control signal D through the amplification circuit 18, and the degree of opening of said on-off valve 11 increases with the rising of the output value of the control signal D (the output signal C of the integration circuit 17), whereby the cooling water within the water jacket 3 is fed to the radiator 4 so as to correspond to the opening degree of the on-off valve 11, and the circulating amount of the cooling water passing through the radiator 4 is gradually increased.

When the circulating amount of the cooling water passing through the radiator 4 increases as described above, the cooling water temperature stops rising, and then, is started to be lowered. At the time point when the cooling water temperature has been lowered to the set value To as referred to earlier, the output signal B of the comparison circuit 16 in the control circuit 14 is changed to "0" as shown by a symbol b' in FIG. 9(2), while the value of the output signal C of the integration circuit 17 and that of the control signal D start to decrease as indicated by a symbol c' in FIG. 9(3), and following the above, the opening degree of the on-off valve 11, i.e., the circulating amount of the cooling water passing through the radiator 4 is reduced. Therefore, the cooling water temperature again rises after having been lowered to the predetermined temperature, and consequently, the cooling water temperature at the outlet **3*a* of the water jacket 3 fluctuates upwardly or downwardly with respect to the set value To as shown by the solid line curve a in FIG. 9(1)**, thus resulting in the hunting.

Incidentally, in the control of the cooling water temperature as described above, when the temperature of the cooling water flowing into the water jacket 3 from the radiator 4 is low owing to low atmospheric temperatures, etc., the engine 1 is more quickly cooled with respect to the constant valve opening speed of the on-off valve 11, thus resulting in a rapid lowering of the cooling water temperature at the outlet **3*a* of the water jacket 3. Therefore, the cooling water temperature largely undershoots below the set value To as shown by a chain line curve a' in FIG. 9(1), with the hunting phenomenon becoming conspicuous. However, when the flow-in cooling water temperature is lowered, the integral constant setting circuit 260 to which the output signal J of the flow-in cooling water temperature sensor 130 indicative of the lowering of the flow-in cooling water temperature is applied through the function circuit 220, determines the integral constant of a small value as shown in FIG. 7, and based on this integral constant, the integration circuit 17** of the control circuit 14 integrates the output signal B of the comparison circuit 16. Accordingly, the signal C produced from the integration circuit 17 of the control circuit 14 has a gentle gradient as indicated by a dotted line c″ in FIG. 9(3). This means that the control gain of the control with respect to the on-off valve 11 by the control circuit 14 is reduced, and thus, the valve opening speed of the on-off valve 11 when the cooling water temperature has exceeded the set value To and/or the increasing speed of the cooling water circulating amount passing through the radiator 4 are to be alleviated. As a result, lowering of the cooling water temperature at the outlet 3*a* of the water jacket 3 becomes gentle in spite of the low flow-in cooling water temperature, and the undesirable undershooting or hunting may be alleviated as shown by the solid line curve a in FIG. 9(1).

It should be noted here that although the hunting phenomenon, as referred to above in the case where the flow-in cooling water temperature is low, may be prevented if the control gain or integral constant are set at a small value from the initial stage, the problem related to the delay in response becomes conspicuous in a normal case where the flow-in cooling water temperature is not particularly low, and therefore, it takes a long period of time for the cooling water temperature to be lowered to the set value, for example, when the heating value of the engine is large, thus resulting in such inconveniences as over-heating of the engine, etc. With respect to the above, since the present invention is arranged to reduce the control gain only when the flow-in cooling water temperature is low, it is free from the delay in response during the normal period, while the problem related to the hunting due to the low flow-in cooling water temperature may be eliminated.

It should also be noted that in the cooling arrangement W2 as described so far, although it is arranged that the control gain is altered based only on the flow-in cooling water temperature detected by the flow-in cooling water temperature sensor 130, the arrangement may be so modified that the control gain is altered according to the difference between the water temperatures at the inlet 3*b* and the outlet 3*a* of the water jacket 3, based on the output signal J of the flow-in cooling water temperature sensor 130 and the output signal A of the water temperature sensor 13 provided at the outlet 3*a* of the water jacket 3 so as to obtain the similar functions.

Another modification to obtain the same effects as above may be such that the flow-in temperature and flow-out temperature of the cooling water as shown in FIG. 10 are applied to the function circuit 220 instead of the function in FIG. 7 for the output based on such difference, by setting the relation of said difference and the integral constant in such a manner that the integral constant becomes smaller as said difference is reduced.

Figure 11:
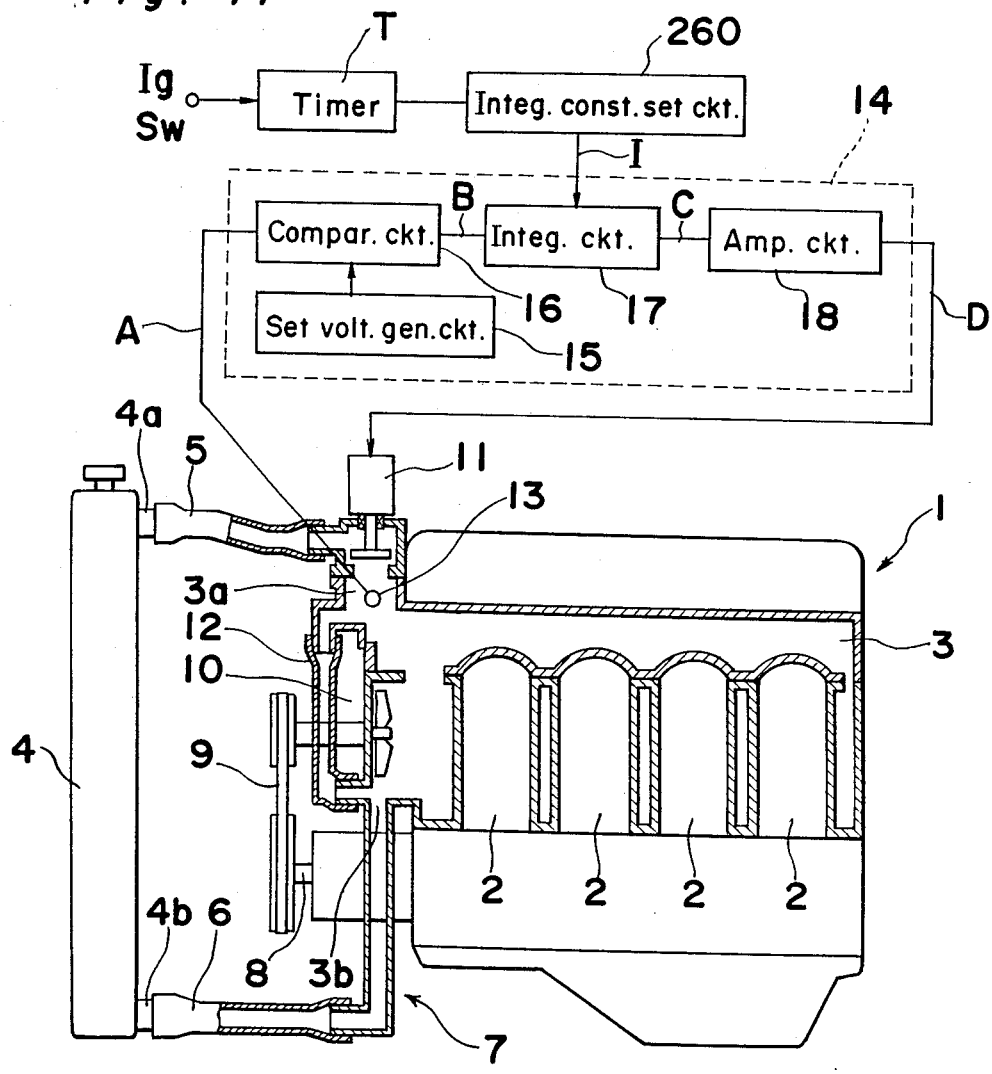
FIG. 11 is a view similar to FIG. 6, which particularly shows a further modification thereof.
Figure 12:
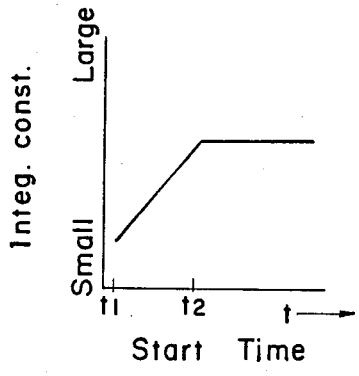
FIG. 12 is a graph for explaining the control characteristics of the modification of FIG. 11.

Furthermore, as shown in FIG. 11, the function circuit 220 in FIG. 6 may be replaced by a starting timer T connected to an ignition switch $I_gSW$ and also to the integral constant setting circuit 260, thereby to determine the constant by the input from the starting timer T. If the relation between the time elapsed after the starting as measured by the starting timer T and the integral constant is so set, as shown in FIG. 12, that the integral constant is proportionally increased from the starting time point t1 up to the predetermined time point t2, and is maintained to be constant after the time point t2, similar effects as in the embodiment of FIG. 6 may be obtained.

As is clear from the foregoing description, according to the above arrangement of the present invention, the control gain is adapted to be reduced with respect to the adjusting device for effecting the adjustment of the cooling water circulating amount when the temperature of the flow-in cooling water flowing into the engine as detected by the flow-in cooling water temperature sensor is low, and therefore, the hunting of the cooling water temperature in the case where the flow-in cooling water temperature is low, may be advantageously suppressed, with the result that the cooling water temperature can be favorably controlled at all times.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A cooling arrangement for a water-cooled internal combustion engine, which comprises a radiator, a water jacket of the internal combustion engine, a cooling water passage for circulating the cooling between said radiator and said water jacket, a cooling water temperature detecting means for outputting signal related to the cooling water temperature detecting means for outputting signal related to the cooling water temperature, an adjusting device for adjusting a circulating amount of the cooling water between said radiator and said water jacket, a cooling water temperature control means for periodically increasing and decreasing the cooling water circulating to the radiator through actuation of the adjusting device by receiving the output of the cooling water temperature detecting means, and which operates the adjusting device in the direction to increase the circulating amount when the cooling water temperature is above a set value, and in a direction to decrease said circulating amount when the cooling water temperature is below a set value, an operating condition detecting means for detecting operating condition of the internal combustion engine, and modifying means for modifying the cooling water circulating amount in the increasing direction of the adjusting device and the circulating amount in the decreasing direction of the adjusting device by said cooling water temperature control means according to the signal received from said operating condition detecting means.

2. A cooling arrangement as claimed in claim 1, wherein said operating condition detecting means is adapted to detect a signal related at least to any one of heat generated by the engine or flow-rate of the cooling water or flow-in cooling water temperature.

3. A cooling arrangement as claimed in claim 2, wherein said operating condition detecting means has a cooling water temperature detecting means for detecting a signal related to temperatures of the flowing-in cooling water so as to decrease the modifying means as the cooling water temperature is lowered.

4. A cooling arrangement as claimed in claim 3, wherein said cooling water temperature detecting means is a water temperature sensor for detecting the flow-in cooling water temperature.

5. A cooling arrangement as claimed in claim 4, wherein the modifying means is adapted to be decreased as a difference between the flow-out cooling water temperature and the flow-in cooling water temperature is increased.

6. A cooling arrangement as claimed in claim 3, wherein said cooling water temperature detecting means has an atmospheric temperature sensor so as to decrease the modifying means when the atmospheric temperature is low.

7. A cooling arrangement as claimed in claim 6, wherein said adjusting means is provided with a pump having a delivery corresponding to engine revolutions, said flow-rate detecting means having a revolution detecting means for detecting a signal related to the engine revolutions, thereby to decrease the modifying means as the engine revolutions are increased.

8. A cooling arrangement as claimed in claim 7, wherein said heating value detecting means is provided with a load detecting means for detecting a signal related to the engine load so as to increase the modifying means as the load is increased.

9. A cooling arrangement as claimed in claim 3, wherein said cooling water temperature detecting means has a timer for detecting time elapsed from starting of the engine so as to decrease the modifying means according to an output of said timer.

10. A cooling arrangement as claimed in claim 2, wherein said operating condition detecting means has a flow-rate detecting means for detecting a signal related to a flow-rate of the cooling water so as to decrease the modifying means as the flow-rate is increased.

11. A cooling arrangement as claimed in claim 10, wherein said adjusting means is provided with a pump having a delivery corresponding to engine revolutions, said flow-rate detecting means having a revolution detecting means for detecting a signal related to the engine revolutions, thereby to decrease the modifying means as the engine revolutions are increased.

12. A cooling arrangement as claimed in claim 2, wherein said operating condition detecting means is provided with a heating value detecting means for detecting a signal related heat generated by the engine so as to increase the control gain as the heating value is increased.

13. A cooling arrangement as claimed in claim 12, wherein said heating value detecting means is provided with a load detecting means for detecting a signal related to the engine load so as to increase the modifying means as the load is increased.

14. A cooling arrangement as claimed in claim 1, wherein said modifying device modifies both of the transfer speed in the circulating amount decreasing direction and the transfer speed in the circulating amount decreasing direction and the transfer speed inthe circulating amount increasing direction.

15. A cooling arrangement as claimed in claim 1, wherein two set temperatures are substantially the same.

16. A cooling arrangement as claimed in claim 1, wherein the operating condition detecting means detects a signal related to the temperature of the cooling water flowing into the engine, and when the water temperature thus flowing in become high, the modifying means reduces the speed in the circulating amount increasing direction, lower than that in the case where the water temperature is low.

17. A cooling arrangement as claimed in claim 16, wherein said cooling water temperature detecting means is a water temperature sensor for detecting the flow-in cooling water temperature.

18. A cooling arrangement as claimed in claim 16, wherein said cooling water temperature detecting means has an atmospheric temperature sensor so as to decrease the modifying means when the atmospheric temperature is low.

19. A cooling arrangement as claimed in claim 1, wherein corresponding to the heat generating amount of the engine, and when the hear generating amount becomes large, the modifying means reduces the speed in the circulating amount decreasing direction, lower than that in the case where the heat generating amount is small.

20. A cooling arrangement as claimed in claim 1, wherein the adjusting device has a valve means provided in the cooling water passage between the engine and the radiator, and said valve means is intended to alter the circulating amount by altering the area of the passage, said modifying device altering the area modifying speed of said valve means.

21. The cooling arrangement as claimed in claim 1, wherein the adjusting device has an actuator electrically operated so as to increase or decrease the circulating amount according to electrical signals from the temperature control means, said temperature control means compares the signal from the temperature detecting means with a basic value, and according to the result thereof, applies the electrical signal to the adjusting device, while said modifying means modifies the above electrical signal.

* * * * *